US006637579B2

(12) United States Patent
Pietz

(10) Patent No.: US 6,637,579 B2
(45) Date of Patent: Oct. 28, 2003

(54) METHOD AND DEVICE FOR REDUCING THE POLYGON EFFECT IN THE REVERSING AREA OF PEDESTRIAN COVEYOR SYSTEMS

(75) Inventor: Alexander Pietz, Hattingen (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/162,750

(22) Filed: Jun. 6, 2002

(65) Prior Publication Data

US 2002/0153224 A1 Oct. 24, 2002

Related U.S. Application Data

(63) Continuation of application No. PCT/EP00/10631, filed on Oct. 28, 2000.

(30) Foreign Application Priority Data

Dec. 6, 1999 (DE) ..... 199 58 709

(51) Int. Cl.[7] ..... B66B 23/02
(52) U.S. Cl. ..... 198/322; 198/323; 198/330
(58) Field of Search ..... 198/322, 323, 198/330

(56) References Cited

U.S. PATENT DOCUMENTS 4,082,173 A * 4/1978 Simon-Kochloffel ..... 198/330
4,671,783 A * 6/1987 Seymour ..... 198/710
5,060,779 A * 10/1991 Landaeus ..... 198/321
5,217,103 A * 6/1993 Unlauf ..... 198/365
5,452,789 A * 9/1995 Wolpers et al. ..... 198/333
5,538,384 A * 7/1996 Haldimann ..... 198/838
5,595,278 A * 1/1997 Ostermeier et al. ..... 198/333
6,070,716 A * 6/2000 Haldimann ..... 198/851
6,142,901 A * 11/2000 Kolling ..... 474/153
6,193,056 B1 * 2/2001 Van Zijderveld et al. ... 198/853
6,351,096 B1 2/2002 Jang
6,450,317 B1 * 9/2002 Fargo et al. ..... 198/330

FOREIGN PATENT DOCUMENTS

| | | |
|---|---|---|
| DE | 23 46 266 A1 | 3/1975 |
| DE | 100 20 787 A1 | 1/2001 |
| EP | 0711725 A1 | 5/1996 |
| GB | 2243430 A | 10/1991 |

OTHER PUBLICATIONS

Klepzig Fachberichte 79, (1971), H 8 M 198–H 8 M 200, pp. 437–439.

* cited by examiner

*Primary Examiner*—Douglas Hess
(74) *Attorney, Agent, or Firm*—Venable LLP; Catherine M. Voorhees

(57) ABSTRACT

The invention relates to a method for reducing the polygon effect that occurs over the course of the reversing of a chain which can be used for a pedestrian conveyor, especially an escalator or moving walkway. To this end, a different rotational speed is superimposed upon the rotational speed of the reversing wheel via the electric drive which indirectly or directly acts upon said reversing wheel.

10 Claims, 1 Drawing Sheet

METHOD AND DEVICE FOR REDUCING THE POLYGON EFFECT IN THE REVERSING AREA OF PEDESTRIAN COVEYOR SYSTEMS

This application is a continuation of PCT/BP0010631 filed on Oct. 28, 2000 in the European Patent Office, designating the United States, and claiming priority of German Application No. 199 58 709.4 filed Dec. 6, 1999. The disclosures of the foregoing applications and each and every U.S. and foreign patent and patent application mentioned herein is incorporated by reference.

BACKGROUND OF THE INVENTION

The invention relates to a method for reducing the polygon effect that occurs during the course of the reversing of a chain, which can be used for a pedestrian conveyor, in particular an escalator or moving walkway.

In the reversing of the chains of pedestrian conveyor systems, in particular escalators and moving walkways, by means of a chain wheel, polygon and revolution effects occur which in particular adversely affect the quiet running of the escalator or moving walkway.

The polygon effect is caused by the square shaped rest of the chain on the chain wheel. With increasing rotation angle, the effective radius of the chain wheel varies, whereby the velocity of the chain oscillates between a maximum and a minimum value. When engaging the chain wheel, the chain rolls and the teeth of the chain wheel have different velocities, which cause impacts. The revolution effect is caused by the angular momentum which is transmitted from the chain wheel onto the chain links and thus onto the steps or pallets. After the chain has run out of the chain wheel, this angular momentum is temporarily maintained due to the inertia of the system, which leads to the so called curling of the chain. The angular momentum is reduced by friction in the chain respectively by impacts between chain and guiding if a chain guiding element is provided.

In a usual arrangement, where the chain wheel drive simultaneously reverses the chain, the chain is guided tangentially to the chain wheel. Thereby the chain wheel and the chain have different velocities when the chain engages the chain wheel. Impacts are caused between the chain and the chain wheel in chain en direction, which can be measured in practice as accelerations of the respective transport elements, such as the steps or pallets of escalators or moving walkways. Besides the developed noise, these periodically occurring impacts lead to high strains of the chain, the chain wheel and the drive.

From EP 0 711 725 a device for guiding a band continuum of escalators or moving walkways is known, in which the chain rolls are guided by means of a supporting rail with a running path and an equalizing rail with a running path. At the entry of a chain wheel, which reverses the band continuum, the chain rolls run from the linear running path of the supporting rail onto the curve shaped running path of the equalizing rail and from this one to a tangent point into engagement with the chain wheel.

From the running path of the supporting rail to the tangent point, the chain rolls are guided into a direction orthogonal to the running direction, over a distance which is transverse to the running direction, towards the chain wheel, which shall have an advantageous effect on the quiet running of the band continuum. This special curve shape of the connection element shall furthermore help to reduce the polygon effect.

The German magazine Klepzig Fachberichte 79 (1971), H 8, M 200, pages 437 through 439 discloses movement problems of chain drives having large chain links. The article discusses consequences of the polygon effect, wherein a number of solution possibilities in the mechanical field are proposed. Inter alia, the reversing of a chain by means of a chain starwheel with equalizing gear is pointed out, wherein the chain bolt maintains its horizontal displacement and velocity as long as the next roll engages and thus a complete chain link has entered the chain starwheel. Only after that, this chain link is reversed, Both publications describe quite extensive mechanical construction works for reducing the consequences of the polygon effect in the reversing of the chain over a reversing wheel.

SUMMARY OF THE INVENTION

It is the object of the invention to provide a method and a device, by means of which the polygon and revolution effects can be reduced while substantially maintaining the usual reversing conditions, in order to optimize the quiet running of the pedestrian conveyor system, in particular the escalator or moving walkway, in this manner.

On the one hand, this aim is achieved by a method for reducing the polygon effect at occurs during the course of the reversing of a chain, which can be used for a pedestrian conveyor system, in particular an escalator or moving walkway, by superimposing a different rotational speed upon the rotational speed of the reversing wheel via the electric drive, which indirectly or directly acts upon said reversing wheel.

Furthermore, this aim is achieved by a device for reducing the polygon effect that occurs during the course of the reversing of a chain, which can be used for a pedestrian conveyor system, in particular an escalator or moving walkway, at least comprising one electric driving motor, which is connected to at least one gear, if necessary, and which indirectly or directly acts upon the reversing wheel, wherein the driving motor is connected to at least one power supply unit, in particular a frequency converter, so that the driving motor can be driven with a non-constant speed.

In contrast to the modifications in the mechanical field, which have been made use of so far, the object of the invention proposes a concept including a solution which is based on modifications of the electric drive.

Usually asynchronous A.C. motors are used, which are brought into active relation with a power supply unit, such as a frequency converter, so that the motor can be driven in such a way that it rotates with a non-constant speed, which then acts upon the respective reversing wheel in a corresponding way, if necessary, in combination with a gear. The varying chain velocities, which are given when the chain runs in, are almost compensated by the object of the invention, or an adaptation thereto is realised, so that the impacts, which have been occurring in the system so far, are compensated.

Preferably the phase position of the chain wheel and/or the rotational speed of the chain are measured, wherein the measured value respectively the measured values are transmitted to a control unit, which treats them in a corresponding way and transmits them to the frequency converter.

For the purpose of setting a basic superposition already those values can be used, which were measured for older escalators and moving walkways, and which result, after a corresponding treatment, in a certain frequency in Hertz, by which a rotational speed can be superimposed upon the respective reversing wheel via a corresponding drive of the electric driving motor.

Besides reducing the polygon effect, the object of the invention considerably improves the quiet running of the pedestrian conveyor system, without requiring any modifications in the mechanical field. Manufacturing tolerances of the reversing wheel and/or the chain can be stored by interpolation of the control unit respectively the power supply unit, wherein the monitoring of the phase angle or the rotational speed of the chain in the operating status offers further possibilities of intervention, which in particular have positive effects when the transport velocity varies between 0 and the maximum The object of tile invention can be used in numerous applications and considered as cheaper than the usual mechanical modifications due to the continuously decreasing prices of electric or electronic components.

The object of the invention is represented in the drawing by means of an exemplary embodiment and described as follows.

BRIEF DESCRIPTION OF THE DRAWINGS

Referring to FIG. 1, there is shown a reversing wheel 2 provided with several teeth 3, a bracket chain 5 consisting of several links 4, as well as an electric driving motor, which, in case of need, is in active relation with a here no further represented gear. The connection between driving motor 6 and reversing wheel 2 is realised by driving member 7. The running direction of chain 5 respectively the reversing direction of reversing wheel 2 is indicated by arrows. According to the invention, the polygon effects, which occur during the entry of chain 5 into reversing wheel 2, are reduced in that a different rotational speed is superimposed upon the rotational speed of reversing wheel 2, so that reversing wheel 2 is rotating with a non-constant rotational speed, which largely corresponds to the mathematical function of chain 5 during the entry into reversing wheel 2, whereby the impacts in the entire system, which occur because of the polygon effect, are minimised.

Figure 1:
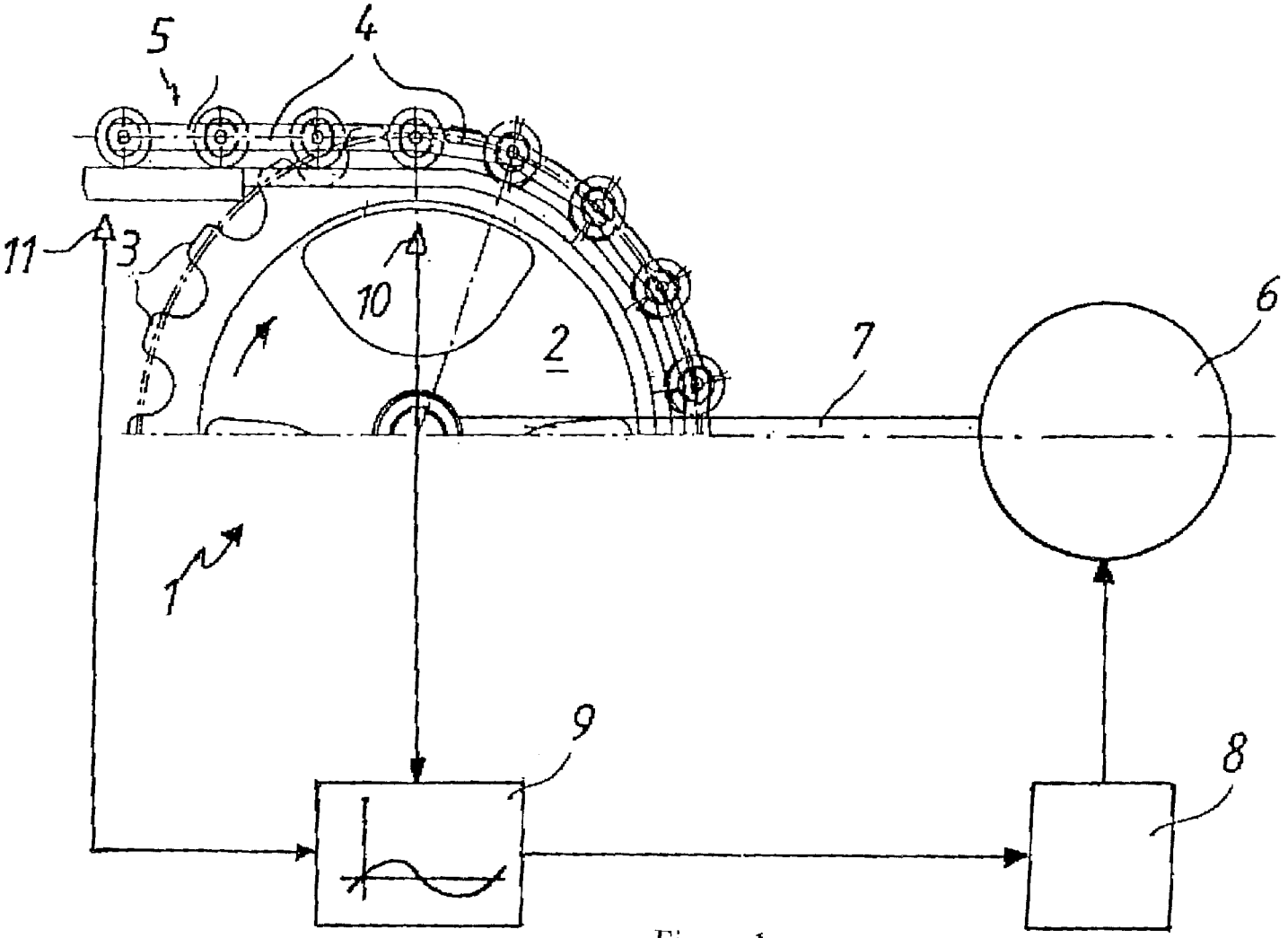
FIG. 1 shows the schematic diagram of an only indicated pedestrian conveyor system, e.g. an escalator 1.

This superposition is achieved by a frequency converter 8 being in active relation with driving motor 6, which frequency converter drives driving motor 6 in such a way that this one rotates with a non-constant rotational speed and this non-constant rotational speed is transmitted to reversing wheel 2 in a superimposing way via driving member 7. In a control unit 9 several driving parameters can be stored, which include the basic patterns of already existing escalators or moving walkways, so that these basic settings can be used for standard designs.

If the comfort shall be further increased, it is possible to detect the phase position of reversing wheel 2 by means of a sensor 10 and to transmit this phase position to control unit 9. Another parameter can be the rotational speed of chain 5, which is for instance measured by another sensor 11, wherein also these measured valves are transmitted to control unit 9. By means of a corresponding equalization of the values measured by sensors 10, 11 in comparison with the present basic pattern(s) frequency converter 8 can be supplied with electric values in such a way that driving motor 6 can be continuously adapted to different rotational speeds of chain 5.

What is claimed is:

1. A method for reducing the polygon effect that occurs during the course of reversing a chain, which can be used for a pedestrian conveyor system, comprising the step of:

superimposing a different rotational speed upon the rotational speed of a reversing wheel about which the chain that is being reversed is guided via an electric drive, where said electric drive indirectly or directly acts upon said reversing wheel, wherein said electric drive is driven by at least one power supply unit in such a way that said electric drive rotates with a non-constant rotational speed (n), which substantially corresponds to a mathematical function of the chain and then acts upon said reversing wheel in an equalizing manner, and wherein at least one of the phase position of said reversing wheel and the velocity of the chain is respectively measured and this measured value is transmitted to and compared to stored values in a control unit, which is electrically connected to the at least one power supply unit thereby allowing the one power supply unit to be adjusted accordingly.

2. The method according to claim 1, wherein the chain is used in a pedestrian conveyor system and the pedestrian conveyor system is one of an escalator and moving walkway.

3. The method according to claim 1, wherein said electric drive is connected to a gear, and the reversing wheel is acted upon by the non-constant rotational speed (n) of said electric drive in combination with the gear.

4. The method according to claim 1, wherein the at least one power supply unit is a frequency converter.

5. The method according to claim 1, wherein the phase position of said reversing wheel and the velocity of the chain are measured and these measured values are transmitted to a control unit, which is electrically connected to the power supply unit.

6. A device for reducing the polygon effect that occurs during the course of reversing a chain, which can be used for a pedestrian conveyor system, said device comprising:

a reversing wheel about which the chain that is being reversed is guided;

an electric driving motor which indirectly or directly acts upon said reversing wheel;

at least one power supply unit coupled to said electric driving motor so that said electric driving motor can be driven with a non-constant rotational speed; a control unit having stored values and at least one sensor for detecting and measuring the phase position of said reversing wheel, said at least one sensor transmitting a measured value of the phase position and comparing to the stored values of the control unit, thereby adjusting the at least one power supply unit accordingly.

7. The device according to claim 6 further comprising at least one additional sensor for detecting and measuring the rotational speed of the chain, said at least one additional sensor transmitting its measured values to the control unit, which cooperates with the power supply unit.

8. The device according to claim 6, wherein the chain is used in a pedestrian conveyor system and the pedestrian conveyor system is one of an escalator and moving walkway.

9. The device according to claim 6, wherein said electric drive is connected to a gear, and the reversing wheel is acted upon by the non-constant rotational speed (n) of said electric drive in combination with the gear.

10. The device according to claim 6, wherein the at least one power supply unit is a frequency converter.

* * * * *